US005240343A

United States Patent [19]

Strobl, Jr.

[11] Patent Number: 5,240,343

[45] Date of Patent: Aug. 31, 1993

[54] HOLDING DEVICE FOR PAVING BLOCKS

[75] Inventor: Frederick P. Strobl, Jr., Cary, Ill.

[73] Assignee: Snap Edge Corporation, Ill.

[21] Appl. No.: 852,268

[22] PCT Filed: Dec. 11, 1990

[86] PCT No.: PCT/US90/07261

§ 371 Date: Jun. 8, 1992

§ 102(e) Date: Jun. 8, 1992

[87] PCT Pub. No.: WO91/09175

PCT Pub. Date: Jun. 27, 1991

[63] Continuation of Ser. No. 537,238, Jun. 13, 1990, abandoned which is a continuation of 448,960, Dec. 12, 1989, abandoned.

[51] Int. Cl.[5] ..... E01C 11/22; E01C 19/52

[52] U.S. Cl. ..... 404/7; 404/8; 52/102

[58] Field of Search ..... 404/7, 8, 99, 18, 27, 404/28, 37, 29; 52/567-570, 571, 572, 573, 578, 581-583, 102; 256/19, 29; 47/23, 24, 33, 32

[56] References Cited

U.S. PATENT DOCUMENTS 1,979,979 11/1934 Martini ..... 47/33
3,676,952 7/1972 Watts ..... 404/6 X
4,824,068 4/1989 Ferland ..... 249/4 X
4,831,776 5/1989 Fritch ..... 47/9 X
4,846,437 7/1989 Fitzgerald ..... 249/3
4,863,307 9/1989 Jones ..... 404/7

FOREIGN PATENT DOCUMENTS 3600738 7/1987 Fed. Rep. of Germany ..... 404/99

*Primary Examiner*—Ramon S. Britts
*Assistant Examiner*—James A. Lisehora
*Attorney, Agent, or Firm*—Staas & Halsey

[57] ABSTRACT

A holding device for paving blocks which has a vertical side for contacting the paving stones is strongly buttressed to hold the paving blocks. At pre-selected points along the vertical side are belts of material perpendicular thereto. Buttressing each belt of material in the vertical edge are gusset members supported by a boss member. The boss member provides for driving a nail into the ground and through the support member in order to hold the holding device for paving blocks in position. The nail is a barbed, X-cross-section nail which may be used to secure the holding device for paving blocks.

27 Claims, 5 Drawing Sheets

FIG. 2
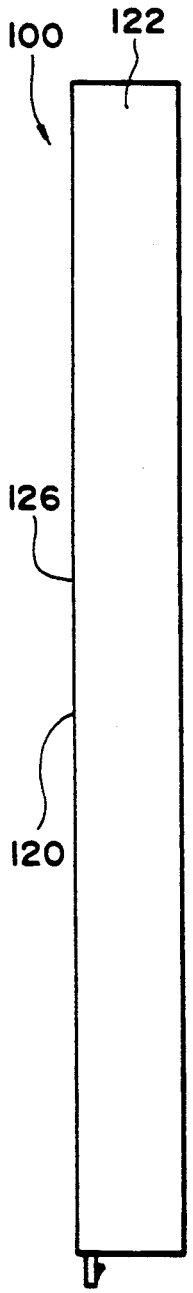
FIG. 3
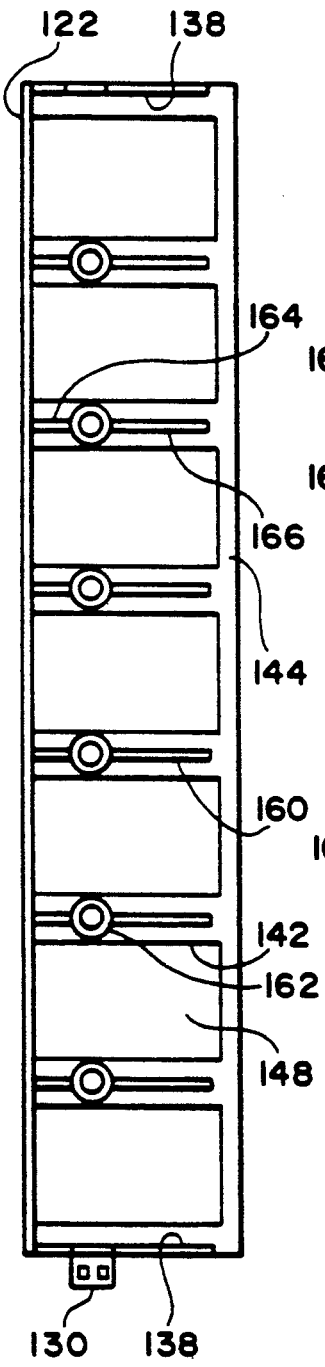
FIG. 4
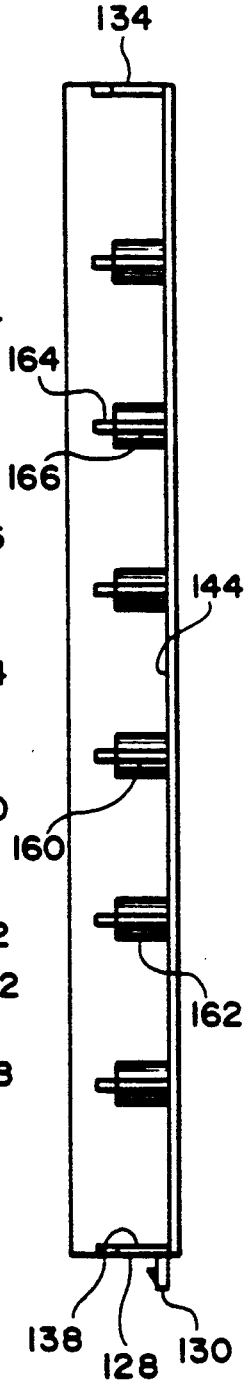
FIG. 5
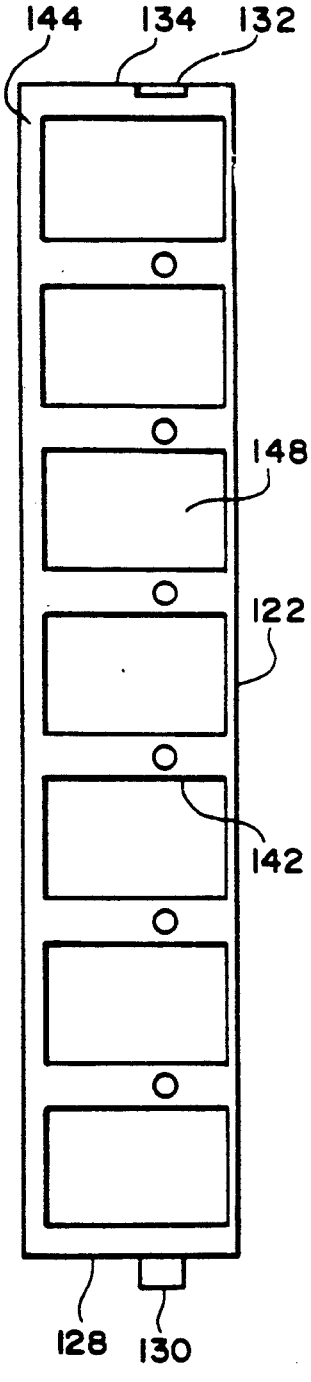
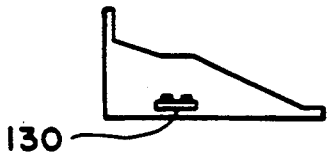
FIG. 6

HOLDING DEVICE FOR PAVING BLOCKS

This application is a national stage of PCT/US90/07261, which is a continuation of application Ser. No. 07/537,238, filed Jun. 13, 1990, now abandoned, which in turn, was a continuation of application Ser. No. 07/448,960, filed Dec. 12, 1989, also now abandoned.

BACKGROUND OF THE INVENTION

The invention relates to a holding device and more particularly to a holding device which fits around the edge of paving blocks.

Paving blocks are commonly used in landscaping to achieve both a decorative and a utilitarian function.

However, the natural freezing and thawing cycle of the ground upon which blocks are laid, as well as vehicular and pedestrian traffic, causes movement of the blocks. Such movement destroys both the decorative and the utilitarian function of the blocks.

Thus, it becomes well settled in the art that it is highly desirable to hold paving blocks in place. Various edge support arrangements exist to hold paving blocks in place. The edge support arrangements of the prior art are difficult to construct and bring to bear on the problem.

Typical of the problems caused for an edge support arrangement is the fact that various surfaces are presented by the edge of paving blocks where the holding mechanism is desired. In some cases the edge of the paving blocks can present a straight line to be supported. In other cases, the edge of the paving blocks can present an arcuate (or curved) surface for an edge support arrangement to support. By arcuate is meant a curved or irregularly shaped surface.

When this paving surface is arcuate, it is difficult to adjust the holding mechanism to the appropriate shape. When it is straight it is possible to hold the paving block in position with a straight support mechanism. However, two completely separate mechanisms are required by the prior art for holding the paving blocks in position, when different edges are presented. It is highly desirable to hold the paving blocks in position with one type of device, which can be easily modified at the job site. If this can be accomplished, it is easier to provide the necessary edge supporting material.

Also, the length of the edge support arrangement required can provide a problem. The longer the edges of the paving blocks which require support, the more difficult it is to achieve the desired positioning of the edge support arrangement. Furthermore, as the paving block area extends, the edge may be arcuate, then straight, and then back to arcuate again in a continuous fashion. It is highly desirable to have one easily modified unit to provide the required edge support for any edge shape of the paving blocks.

Long units of an edge support arrangement present many difficulties. Firstly only certain lengths of material are permitted to be hauled on highways. Secondly, handling of long units presents difficulties at the job site. Additionally, other transportation problems can exist. For example, the structure cannot be compactly fitted into a truck or transportation means. So the long units provide transportation problems and handling difficulties on the job site.

To provide for joining of units of an edge support arrangement to achieve a desired length to solve the long unit problems presents many other problems. The joint inherently produces a weakness in the device. Functioning of the joining device on the job site also presents a problem. Many different parts are required for the joining. A special effort is required to have all of those parts available. Joint strength is inversely proportional to the ease of joining the units. Having the required joining members available may also present a problem.

Holding the edge support in position is a difficult matter. The strength of the support must be maintained, and the support must be left in position—even during a freeze/thaw cycle. The freeze thaw cycle can force nails holding the support to come loose. A single unit is desired to achieve that holding force. Structure must be developed to avoid that problem.

Nothing holds a paving block holding device in position better than a good root system. It is important that the root system be able to lock into the holding device. Holding devices known in the prior do not permit this desired root interlocking.

Thus, it can be seen that there are a substantial number of problems in achieving an appropriate support for a group of paving blocks.

SUMMARY OF THE INVENTION

Accordingly, among the many objectives of this invention, is to provide a holding device for paving blocks.

A further objective of this invention is to provide a holding device for paving blocks to minimize movement of the paving blocks.

A still further objective of this invention is to provide a holding device for paving blocks to maintain the decorative function of the paving blocks.

Yet a further objective of this invention is to provide a holding device for paving blocks to maintain the utilitarian function of the paving blocks.

Also an objective of this invention is to provide a holding device for paving blocks which is easy to construct.

Another objective of this invention is to provide a holding device for paving blocks capable of holding straight, arcuate, or irregularly shaped edges of a group of paving blocks.

Still another objective of this invention is to provide a holding device for paving blocks, which is easily modified at the job site.

Yet another objective of this invention is to provide a holding device for paving blocks having an easily adjustable length.

A further objective of this invention is to provide a holding device for paving blocks which is adjustable in shape along the length thereof.

A still further objective of this invention is to provide a holding device for paving blocks which is easily handled at the job site.

Yet a further object of this invention is to provide a holding device for paving blocks which has easily joined segments.

Also an objective of this invention is to provide a holding device for paving blocks which has sections which can be strongly joined together.

Another objective of this invention is to provide a holding device for paving blocks which has sections which can be strongly positioned in relation to the ground.

Yet another objective of this invention is to provide a holding device for paving blocks which can be easily transported.

A further objective of this invention is to provide a holding device for paving blocks capable of holding straight, arcuate, or irregularly shaped edges of a group of paving blocks, which is a single unit system easily formed at a job site.

These and other objectives of this invention (which other objectives become clear by considering the specification, claims and drawings as a whole) are met by providing a holding device for paving blocks which has a vertical side for contacting the paving stones. At preselected points along the vertical side are belts of material perpendicular thereto. Buttressing each belt of material in the vertical edge are gusset members supported by a boss member. The boss member provides for driving a nail into the ground and through the support member in order to hold the holding device for paving blocks in position. The nail is a barbed, cross-section nail which may be used to secure the holding device for paving blocks.

BRIEF DESCRIPTION OF THE DRAWINGS

FIG. 2 is a front elevation view of the holding device for paving blocks of this invention.

FIG. 3 is a top plan view of the holding device for paving blocks of this invention.

FIG. 4 is a rear elevation view of the holding device for paving blocks of this invention.

FIG. 5 is a bottom view of the holding device for paving blocks of this invention.

FIG. 6 is a tab end plan view of the holding device for paving blocks of this invention.

Throughout the figures of the drawings where the same part appears in more than one figure of the drawing, the same number is applied thereto.

DESCRIPTION OF THE PREFERRED EMBODIMENTS

Figure 1:
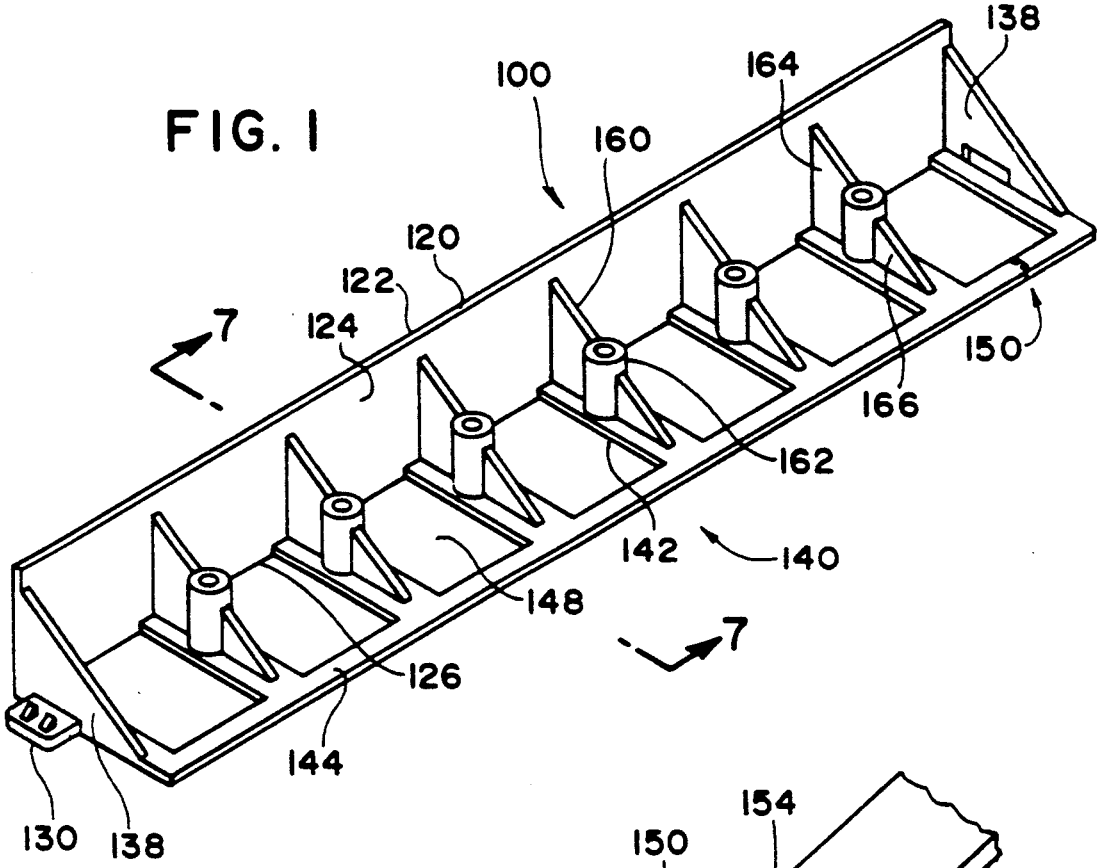
FIG. 1 is a rear perspective view of the holding device 100 for paving blocks (not shown) of this invention.

The holding device for paving blocks of this invention includes a vertical plate for contacting the paving blocks and various supporting points for the vertical plate. At pre-selected points along the vertical plate are belts of material perpendicular thereto. Buttressing the belts of material in the vertical plate are gusset members supported by a boss member. The boss member provides for driving a nail into the ground and through the support member in order to assist in positioning the holding device for paving blocks until a root system can develop to more solidly position the holding device.

It is difficult to hold the nail in the holding device due to the heaving and pitching caused at the frost line (freezing and refreezing of the ground). The frost line problem is avoided by the barbs on the nail which passes through the boss member as the nail is driven therethrough and locked within the edge support. In this manner, the holding device is positioned until a root system is developed to secure the positioning. The nail is most suitable for use in frost free ground, and can be used to position the holding device until the root system develops.

Capping the edge support or the individual strips is a long member strip running the length of the vertical plate. In this fashion, between the gusset members and the edge support are provided openings for grass and other vegetation to grow therethrough and support the positioning of the edge support strip.

On a tab end of the holding device for paving blocks is a male member suitable for locking one holding device to another. The tab end cooperates in locking one holding device to another with the female member on the other end of the holding device. The holding device has integral fastening devices built therein. A highly desired strength support is achieved. In this fashion, varying lengths of paving blocks can be supported by a long device formed by using a number of holding devices.

If it is desired to form a bendable member, the strips across the rear edge may be cut and, if required, a portion thereof removed. Merely cutting is usually sufficient. It is also possible to have a breakable point in the long member strip. In this fashion, the bending can be achieved in a concave or convex fashion to go around curves formed by paving blocks.

It is also possible to put in boss members for stacking of the holding devices. In this fashion, transportation of a plurality of holding devices becomes simplified.

In order to make the holding device for paving blocks of this invention any suitable process may be used. However, the unique shape of this device permits the use of injection molding of a plastic or synthetic resin to provide a strong device, which may be used in an efficient manner. The tab set up and the molding permits highly efficient production and reproducibility of the holding device. In this fashion, great advantages are obtained. Stacking bosses can be placed at the mold knockout points and achieve the desired efficient combination and effective use of this holding device.

Referring now to FIG. 1, FIG. 2 and FIG. 3 the holding device for paving blocks includes a vertical plate 120. The vertical plate 120 is a long flat piece of material having a contact side 122 for contacting the paving blocks and a support side 124 for receiving a support member 140 having a plurality of parts at various points along the vertical plate 120. At pre-selected points along the vertical plate 120 are belts 142 forming part of support member 140. Each belt 142 is substantially perpendicular to the vertical plate 120 at a bottom edge 126 thereof.

Capping each end of the holding device for paving blocks is a trapezoid cap 138. The trapezoid cap 138 supports the vertical plate 120 and support member 140 in their relationship.

Buttressing each belt 142 between each trapezoid cap 138 is a gusset member 160 supported by a centrally located boss member 162. This boss member 162 is substantially parallel to the vertical plate 120, and provides for driving a nail 200 (shown in FIG. 14) into the ground to hold the holding device 100 in position. The nail 200 passes through boss member 162 because boss member 162 is a hollow cylinder.

A first slab 164 is between the boss member 162 and vertical plate 120 as an integral support therefore. A second slab 166 is on a side of boss member 162 opposite first slab 164 and also supports the boss member 162. Preferably for ease of molding, first slab 164 is of trapezoidal shape and second slab 166 is of triangular shape.

Capping the belts 142 is a capping strip 144. Second slab 166 is adjacent to the capping strip 144. Both the belts 142 and the capping strip 144 are flat material. The longitudinal axis of the capping strip 144 is substantially perpendicular to the longitudinal axis of each belt 142. In this manner a common plane is defined by belts 142 and capping strip 144. This common plane is substantially perpendicular to plane defined by vertical plate 120. In this fashion, belts 142, vertical plate 120, and capping strip 144 combine to provide a plurality of openings 148 of generally rectangular shape for grass or other vegetation to grow therethrough and support the positioning of the holding device for paving blocks.

Figure 16:
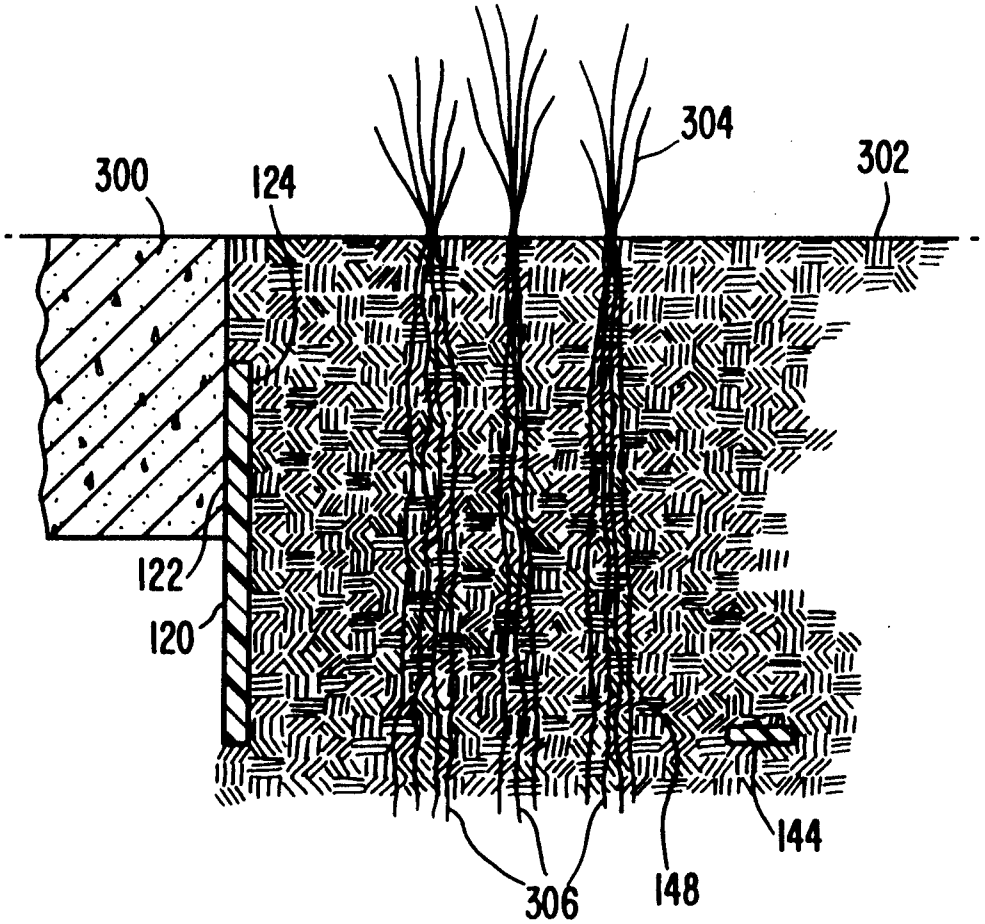
FIG. 16 is a cross-sectional view showing the holding device of FIG. 1 in position against a paving stone in a back-filled installation.

FIG. 16 shows the holding device of the invention in place against a paving stone 300 in a back-filled installation. As can be seen in this Figure, the contact side 122 of vertical plate 120 contacts stone 300 to hold the latter in place. The installation is back-filled with earth fill 302 which supports the support side 124 of plate 120. Grass 304 has roots 306 which extend through opening 148 to provide support for the earth fill material 302. As can be seen, opening 148 is defined at the front by plate 120 and at the rear by capping strip 144.

Referring now to FIG. 3, FIG. 4, FIG. 6, FIG. 11, FIG. 12 and FIG. 13, on a tab end 128 of the holding device for paving blocks is a male member 130 suitable for locking to other members. The tab end 128 cooperates in locking one holding device 100 to another with the female member 132 on the receiving end 134, to provide highly desired strength for the joint. The trapezoid cap 138 is located at each of tab end 128 and receiving end 134. In this situation, any suitable length can be formed by using a number of holding devices 100.

Figure 14:
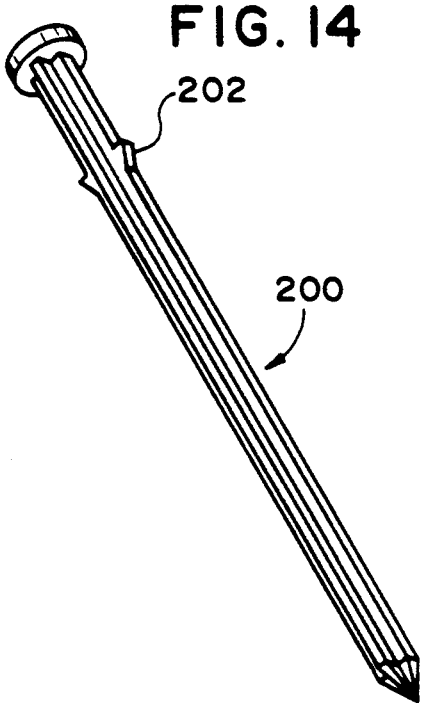
FIG. 14 is a perspective view of the nail 200 for use with the holding device for paving blocks of this invention.
Figure 7:
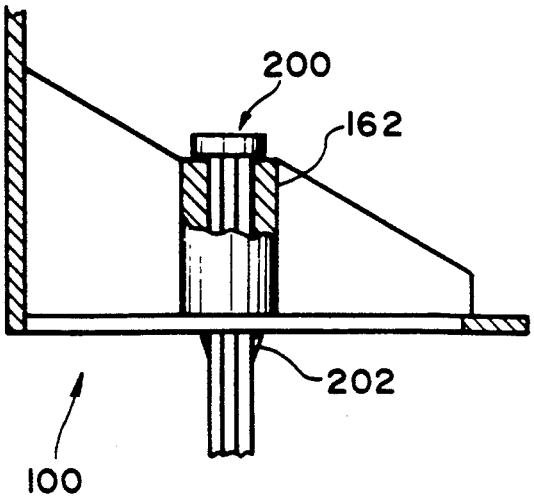
FIG. 7 is a partial cross-sectional view of the holding device for paving blocks taken along section line 7—7 in FIG. 1 to show nail 200 of this invention.

FIG. 7 and FIG. 14 depict a special nail 200 for use herewith. It is difficult to hold a nail in the holding device 100. The frost line problem is avoided by the barbs 202 on the nail 200 which goes through the boss member 162 at a boss aperture 164 and locks within the boss member 162.

Figure 8:
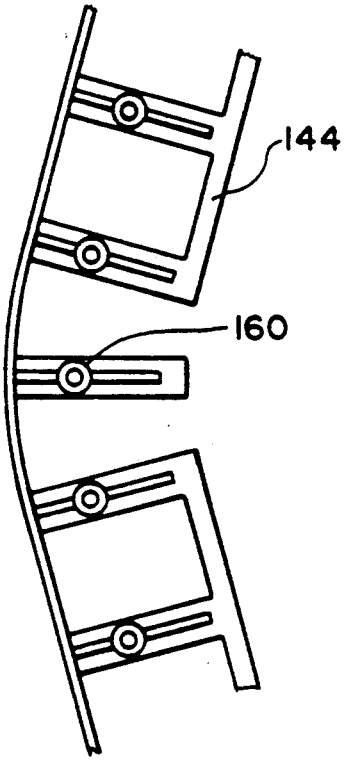
FIG. 8 is a top plan view of the holding device for paving blocks of this invention showing a convex arc.
Figure 9:
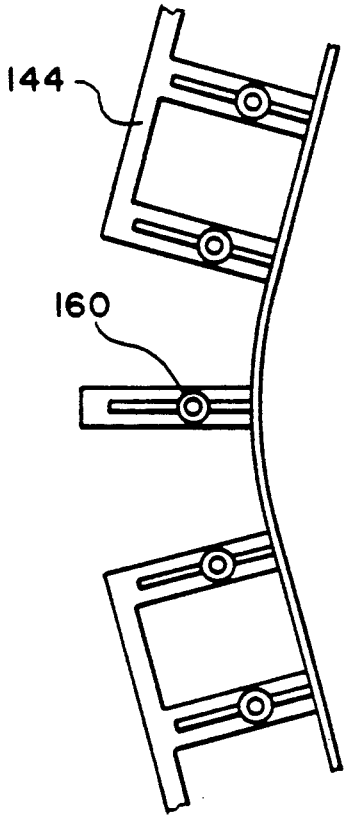
FIG. 9 is a top plan view of the holding device for paving blocks of this invention showing a concave arc.

A bendable version of the holding device for paving blocks can be formed as shown in FIG. 8 and FIG. 9 by cutting and separating capping strip 144. Also removing a section of the capping strip 144 between a pair of gusset members 160 is possible but not required. Mere separation of the capping strip 144 can achieve the bendable nature of vertical plate 120, and hence the holding device for paving blocks as desired.

Figure 15:
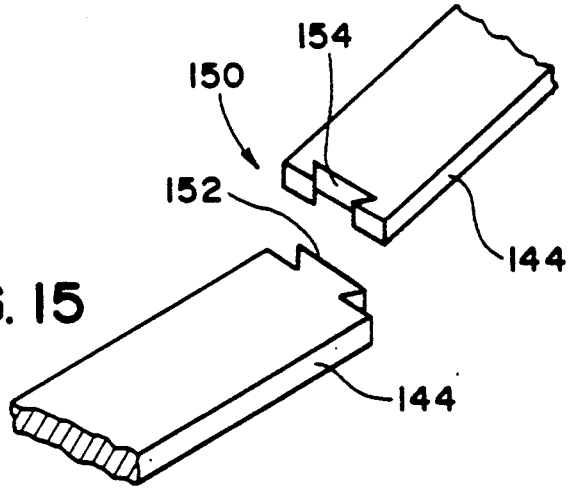
FIG. 15 is an exploded view of the snap mechanism 150 for use with the holding device for paving blocks of this invention.

By considering FIG. 15 with FIG. 1, the capping strip 44 may additionally have a snap mechanism 150 having a male snap 152 and female snap 154 across the capping strip 144. Capping strip 144 may then be separated or rejoined as desired between a pair of gusset members 160. With the separation of the capping strip 144, the bending of vertical plate can be achieved in a concave or convex fashion to go around curves formed by paving blocks—without cutting.

Figure 10:
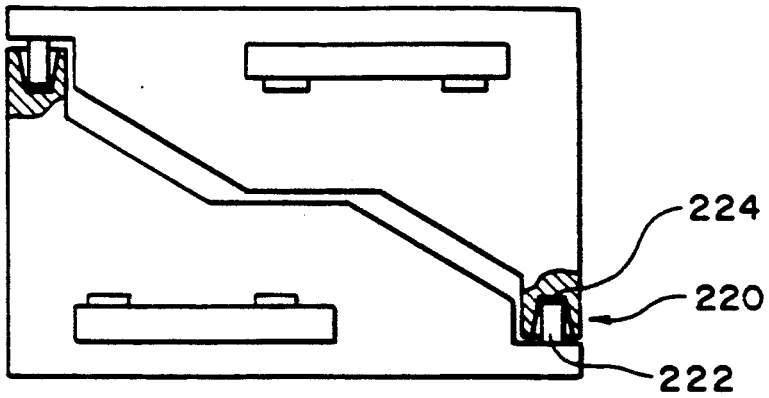
FIG. 10 is a partial section of the holding device in a stacked arrangement.
Figure 11:
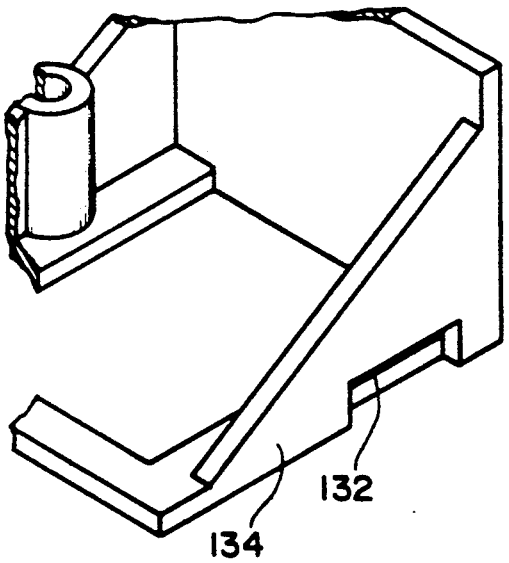
FIG. 11 is a tab-receiving end perspective view of the holding device for paving blocks of this invention.
Figure 12:
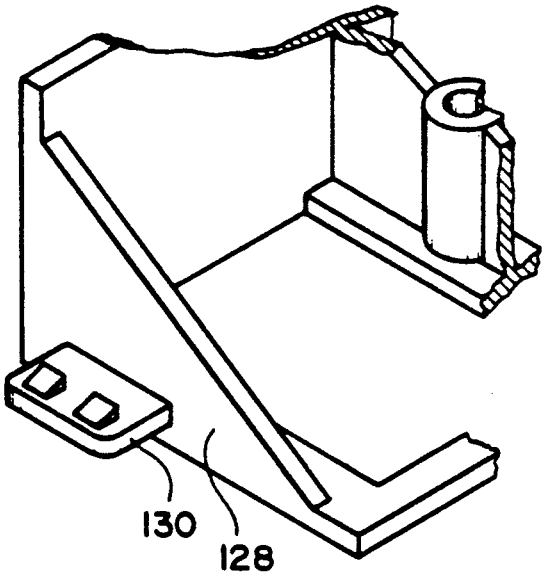
FIG. 12 is a tab protruding end perspective view of the holding device for paving blocks of this invention.
Figure 13:
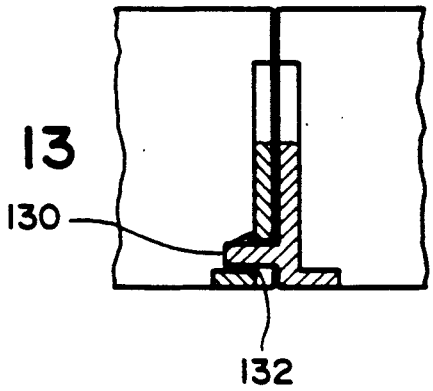
FIG. 13 is a partial cross-sectional side view of the holding device for paving blocks of this invention showing the tab-receiving end and tab protruding end joined together.

It is also possible as shown in FIG. 10 to put in stacking boss members 220 for stacking of the holding devices 100. Stacking boss members 220 may include a male boss member 222 on capping strip 144 and the female boss member 224 on vertical plate 20 at top edge 128 thereof. In this fashion, transportation of a plurality of holding devices 100 becomes simplified.

This application—taken as a whole with the specification, claims, abstract and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

I claim:

1. A holding device for paving blocks including a vertical plate for contacting said paving blocks and a supporting means for said vertical plate, wherein:

a. at least two belts of material are secured substantially perpendicularly to said vertical plate at a bottom edge of said vertical plate;

b. the supporting means comprise a triangulated member extending between a belt and said vertical plate;

c. said triangulated member is supported by a boss member;

d. said boss member includes an aperture for driving a nail into the ground by passing through said boss member in order to keep said holding device for paving blocks in proper position;

e. a capping strip is integrally secured to said at least two belts of material substantially perpendicular to said at least two belts to provide a generally rectangular opening surrounded by said belts, said bottom edge and said capping strip;

f. said holding device further includes a triangulated piece at each end thereof;

g. said holding device further includes a tab end at one triangulated piece and a tab-receiving end disposed at the other end of the holding device; and h. said tab end includes a male member suitable for locking to a female member on said tab-receiving end so that a first holding device may be joined to a second holding device such that a triangulated piece on said first holding device is adjacent a triangulated piece on said second holding device.

2. The holding device for paving blocks of claim 1, wherein a portion of said capping strip between said at least two belts of material is severable to make said vertical plate flexible.

3. A holding device for paving blocks including a vertical plate for contacting said paving blocks and a supporting means for said vertical plate, said supporting means comprising:

a. at least two belts of material secured substantially perpendicularly to said vertical plate at a bottom edge thereof;

b. buttressing structure interconnecting the belts and said vertical plate, said buttressing structure including a boss member; and c. a capping strip joining said belts, a portion of said capping strip being removable to make said vertical plate flexible.

4. A holding device for paving blocks including a vertical plate for contacting said paving blocks and a supporting means for said vertical plate, said supporting means comprising:

a. at least two belts of material secured substantially perpendicularly to said vertical plate at a bottom edge thereof;

b. buttressing structure interconnecting the belts and said vertical plate, said buttressing structure including a boss member; and c. a tab end at one end of the holding device and a tab-receiving end oppositely disposed from said tab end, said tab end including a male member suitable for locking to a female member on said tab-receiving end so that a first holding device may be joined to a second holding device such that a triangulated piece on said first holding device is adjacent a triangulated piece on said second holding device.

5. The holding device for paving blocks of claim 4, wherein:

a. said boss member includes an aperture to receive a nail into the ground after passing through said aperture in order to keep said holding device for paving blocks in proper position;

b. a capping strip is secured to said at least two belts of material substantially perpendicular to said at least two belts to provide a generally rectangular opening surrounded by said belts, said bottom edge and said capping strip;

c. said holding device further including a triangulated support piece at each end thereof; and d said holding device further including a tab-joining means for attaching a first member of said holding device to a second member of said holding device.

6. A holding device for paving blocks including a vertical plate for contacting said paving blocks and a supporting means for said vertical plate, said supporting means comprising:

a. at least two belts of material secured substantially perpendicularly to said vertical plate at a bottom edge thereof;

b. buttressing structure interconnecting the belts and said vertical plate, said buttressing structure including a boss member; and c. a gusset member for each belt of said at least two belts, said gusset member being of a generally planar nature, said gusset member having a first edge perpendicular to a plane of said vertical plate, and said gusset member having a second edge perpendicular to a plane of each belt.

7. The holding device for paving blocks of claim 6 wherein:

a. said gusset member is supported by a boss member within said gusset member;

b. said boss member includes an aperture to receive a nail; and c. said nail passes into the ground after passing through said aperture in order to keep said holding device for paving blocks in proper position while a root system is developed.

8. The holding device for paving blocks of claim 7, wherein said nail includes at least one barb.

9. The holding device for paving blocks of claim 7 wherein:

a. a capping strip is secured to said at least two belts and coplanar therewith;

b. said capping strip is substantially equal in length to said vertical plate; and c. said capping strip, said at least two belts and said vertical plate provide an opening for vegetation roots to grow therethrough and support the positioning of said hollow device.

10. The holding device for paving blocks of claim 9 wherein;

a. said holding device for paving blocks has a male member tab end suitable for locking a first said holding device to a second said holding device;

b. said holding device for paving blocks has a female member tab-receiving end suitable for locking a first said holding device to a second said holding device; and c. said female member receives said male member tab.

11. The holding device for paving blocks of claim 10, wherein said capping strip is severable to render said vertical plate bendable.

12. The holding device for paving blocks of claim 11, wherein a portion of said capping strip is removable to render said vertical plate bendable.

13. The holding device for paving blocks of claim 10, wherein said capping strip includes a severable means to render said vertical plate bendable.

14. The holding device for paving blocks of claim 10, wherein said holding device further includes a plurality of boss members to render said first holding device stackable with said second holding device.

15. The holding device for paving blocks of claim 10, wherein said holding device is formed by injection molding.

16. A holding device for paving blocks including a vertical plate for contacting said paving blocks and a supporting means for said vertical plate, wherein:

a. at least two belts of material are secured substantially perpendicularly to said vertical plate at a bottom edge of said vertical plate;

b. a support means supports said at least two belts and said vertical plate;

c. said support means includes a boss member;

d. said holding device further includes a tab end at one end thereof and a tab-receiving end oppositely disposed from said tab end;

e. said tab end includes a male member suitable for locking to a female member on said tab-receiving end so that the first holding device may be joined to a second holding device such that a triangulated piece of said first holding piece is adjacent a triangulated piece on said second holding piece;

f. said boss member includes an aperture to receive a nail into the ground after passing through said aperture in order to keep said holding device for paving blocks in proper position;

g. a capping strip is secured to said at least two belts of material substantially perpendicular to said at least two belts to provide a generally rectangular opening surrounded by said belts, said bottom edge and said capping strip;

h. said holding device further includes a support piece at each end thereof;

i. said holding device further includes a joining means for attaching a first member of said holding device to a second member of said holding device;

j. said support means includes a gusset member for each belt of said at least two belts;

k. said gusset member is of a generally planar nature;

l. said gusset member has a first edge perpendicular to a plane of said vertical plate; and m. said gusset member has a second edge perpendicular to a plane of each belt.

17. The holding device for paving blocks of claim 16 wherein:

a. said gusset member is supported by said boss member within said gusset member;

b. said nail passes into the ground after passing through said aperture in order to keep said holding device for paving blocks in proper position while a root system is developed;

c. said nail includes at least one barb;

d. a capping strip is secured to said at least two belts and coplanar therewith;

e. said capping strip is substantially equal in length to said vertical plate;

f. said capping strip, said at least two belts and said vertical plate provide an opening for vegetation roots to grow therethrough and support the positioning of said holding device; and g. said capping strip is severable to render said vertical plate bendable.

18. The holding device for paving blocks of claim 17, wherein a portion of said capping strip is removable to render said vertical plate bendable.

19. The holding device for paving blocks of claim 17 wherein:

a. said capping strip includes a severable means to render said vertical plate bendable;

b. said holding device further includes a plurality of boss members to render a first holding device stackable with a second holding device; and c. said holding device is formed by injection molding.

20. A device for holding paving materials in place comprising:

an elongated vertical plate having a front surface disposed for facing and contacting the paving material, a lower edge, and a rear surface disposed to face away from the paving material when the device is installed;

support means for supporting the vertical plate including a plurality of elongated, longitudinally spaced, rearwardly extending, ground contacting footing structures, each footing structure having a proximal end secured to the lower edge of the vertical plate and a distal end spaced rearwardly away from said plate; and an elongated capping member secured to the distal ends of at least two of said footing structures to present an opening surrounded by said plate, said footing structures and said member.

21. A device as set forth in claim 20, wherein said member is severable between said distal ends to free the plate for flexure about a vertical axis.

22. A device as set forth in claim 20, wherein said support means includes respective buttressing structures interconnecting each footing structure and the vertical plate.

23. A device as set forth in claim 20, wherein said support means includes a plurality of bosses, each boss having a nail receiving hole extending vertically therethrough.

24. A device as set forth in claim 20, wherein said plate has an upper edge and said capping member has an upper surface, and said device includes mating elements disposed at the top of the plate and at the upper surface of the member to facilitate stacking of the devices for storage and transit.

25. A device as set forth in claim 20, wherein each footing structure comprises a continuous belt of material.

26. A device as set forth in claim 20, wherein each said buttressing structure includes a boss having a nail receiving hole extending vertically therethrough.

27. A device for holding paving materials in place comprising:

an elongated vertical plate having a front surface disposed for facing and contacting the paving material, a lower edge, and a rear surface disposed to face away from the paving material when the device is installed; and supporting means for supporting the vertical plate including a plurality of elongated, longitudinally spaced, rearwardly extending, ground contacting footing structures, each said footing structure having a proximal end that is integrally formed with the lower edge of the vertical plate and a distal end spaced rearwardly away from said plate, said plate and said footing structures together defining a root growth facilitating opening, said support means further including respective buttressing structures interconnecting each footing structure and the vertical plate.

* * * * *